US010665056B2

(12) United States Patent
Ward

(10) Patent No.: US 10,665,056 B2
(45) Date of Patent: May 26, 2020

(54) SYSTEM AND METHOD FOR PROGRESSIVE JACKPOT WAGERING GAMES HAVING DEFICIT METERS

(71) Applicant: NOVOMATIC AG, Gumpoldskirchen (AT)

(72) Inventor: Matthew John Ward, Northbrook, IL (US)

(73) Assignee: NOVOMATIC AG, Gumpoldskirchen (AT)

( * ) Notice: Subject to any disclaimer, the term of this patent is extended or adjusted under 35 U.S.C. 154(b) by 205 days.

(21) Appl. No.: 15/868,021

(22) Filed: Jan. 11, 2018

(65) Prior Publication Data

US 2019/0213834 A1 Jul. 11, 2019

(51) Int. Cl.
*A63F 9/24* (2006.01)
*G07F 17/32* (2006.01)

(52) U.S. Cl.
CPC ..... *G07F 17/3258* (2013.01); *G07F 17/3209* (2013.01); *G07F 17/3211* (2013.01)

(58) Field of Classification Search
CPC .. G07F 17/32; G07F 17/3276; G07F 17/3258; G07F 17/3225
See application file for complete search history.

(56) References Cited

U.S. PATENT DOCUMENTS

| | | | | |
|---|---|---|---|---|
| 5,885,158 A * | 3/1999 | Torango | G07F 17/32 463/27 |
| 9,355,521 B2 | 5/2016 | King | |
| 2006/0052160 A1* | 3/2006 | Saffari | G07F 17/32 463/27 |
| 2006/0142079 A1* | 6/2006 | Ikehara | G07F 17/32 463/27 |
| 2006/0183538 A1* | 8/2006 | Michaelson | G06Q 40/04 463/27 |

* cited by examiner

*Primary Examiner* — James S. McClellan
*Assistant Examiner* — Kevin M Carter
(74) *Attorney, Agent, or Firm* — Lathrop GPM LLP

(57) ABSTRACT

Disclosed is a gaming system for playing a progressive jackpot game including a visible meter and a deficit meter. The system includes a display, a wager acceptor, player-activated buttons, and a processor. A percentage of the wager defines a contribution to the game. Each time the game is played the visible meter is increased by an increment amount. If the deficit meter is less than zero, the increment amount equals a first portion of the contribution, and a second portion of the contribution is added to the deficit value. If the deficit meter is not less than zero, the increment amount equals a third portion of the contribution. When the game is won, the visible meter is reset to a reset value which comprises a base reset value plus a random value, and the random value is subtracted from the deficit meter.

30 Claims, 5 Drawing Sheets

SYSTEM AND METHOD FOR PROGRESSIVE JACKPOT WAGERING GAMES HAVING DEFICIT METERS

BACKGROUND

The present disclosure relates to wagering games, gaming machines, networked gaming systems and methods, and in particular to wagering games, gaming machines, networked gaming systems and methods having progressive jackpot games.

Electronic gaming machines ("EGMs") offer a variety of games such as slot games, video poker games, roulette games, keno games, and other types of wagering games that are commonly deployed at a casino or gaming facility for use by players. Typically, a player using an EGM is required to place one or more wagers on the outcome of the game. The EGMs may be programmed with a predefined set of outcomes including one or more winning outcomes and one or more losing outcomes. Customarily, players are awarded one or more prizes, awards, or jackpots for a winning outcome in the game, and receive no such awards for a losing outcome. Thus, these various types of EGMs allow players to wager on and play a variety of games of chance, in hopes of winning one or more awards, while experiencing entertaining and amusing gameplay on the gaming machine.

Game designers, manufacturers, and operators continually strive to find new and appealing features and game functionality that will generate and increase player excitement and interest in the games played on such EGMs. Primary awards in EGMs typically comprise defined award payouts for resulting winning outcomes, which are often presented to players in the form of a pay table, or payout table, listing winning outcomes or combinations, along with their associated awards. In addition to primary awards, EGMs may include a variety of special awards, such as bonus games, bonus features, multipliers, and jackpots, which have evolved to capture and maintain player interest and enjoyment.

One such special award which has increased in popularity is a progressive jackpot award or game, which may be funded by an EGM which contributes a portion of the wagers received at such EGM towards funding the progressive jackpot award. In this way, the progressive jackpot award grows over time until it is awarded to a wining player. Alternatively, a gaming system may include a collection of EGMs each of which contributes a portion of the wagers received at such EGMs towards funding the progressive jackpot award. By utilizing a system of networked gaming machines, such systems can be configured in a variety of ways. For example, a large number of EGMs may be configured to participate in a progressive jackpot, thereby making the size of the progressive jackpot award higher than if the progressive jackpot were funded only by a single EGM. Therefore, networks of EGMs may include a plurality of gaming machines in a single facility or location (referred to as Local Area Progressives), or may include gaming machines networked together across multiple physical facilities, locations and geographic jurisdictions (referred to as Wide Area Progressives).

Gaming systems and EGMs having progressive jackpot awards may be configured to have a smaller probability of being won by a player, thereby allowing the sizes of the awards of such progressive jackpots to be much larger. In other configurations, the likelihood of winning a progressive jackpot may be increased, which often causes the sizes of such awards to be smaller, but provides players the entertainment of more frequency progressive jackpot awards. In some configurations, after a progressive jackpot is won by a player, and a corresponding award is paid, a progressive jackpot award may be reset to a predetermined reset value or amount (e.g. $1,000). However, players who learn or become aware of the reset value of the EGM may misperceive that when a progressive jackpot is at or near such a reset value, that the players' chances of winning the progressive jackpot are reduced or diminished. Therefore, if a player observes the current value of a progressive jackpot meter to be near the reset value, he or she may be less likely to play the associated progressive jackpot wagering game, or the EGMs in the gaming system including the progressive jackpot. Additionally, players who observe the rate of increase or accumulation of a progressive jackpot award may be more motivated to play the EGM, due to the added anticipation and excitement of perceiving that the jackpot will soon be awarded.

While gaming machines including progressive jackpot games have been successful, there remains a need for progressive jackpot games that provide players with enhanced excitement throughout gameplay. The present invention offers solutions to these and other problems associated with progressive jackpot games.

SUMMARY

The present invention relates to a gaming system and methods for progressive jackpot wagering games having deficit meters.

In an embodiment, a gaming system for playing a progressive jackpot game includes a visible meter and a deficit meter. The system comprises a display for displaying a game of chance, an acceptor for receiving a wager, a percentage of the wager defining a contribution to the progressive jackpot game, one or more player-activated buttons for receiving player input, and a processor which executes game software and processes player input from the player-activated buttons. Each time the progressive jackpot game is played the visible meter is increased by an increment amount, wherein if the deficit meter is less than zero, the increment amount equals a first portion of the contribution, and a second portion of the contribution is added to the deficit meter, and if the deficit meter is not less than zero, the increment amount equals a third portion of the contribution. When the progressive jackpot game is won by a player, the visible meter amount is paid to the player, the visible meter is reset to a reset value, the reset value comprising a base reset value plus a random value, and the random value is subtracted from the deficit meter.

In another embodiment, a gaming system for playing a progressive jackpot game includes a visible meter, a deficit meter, and a hidden meter. The system comprises a display for displaying a game of chance, an acceptor for receiving a wager, a percentage of the wager defining a contribution to the progressive jackpot game, one or more player-activated buttons for receiving player input, and a processor which executes game software and processes player input from the player-activated buttons. Each time the progressive jackpot game is played the visible meter is increased by an increment amount, wherein if the deficit meter is less than zero, the increment amount equals a first portion of the contribution, and a second portion of the contribution is added to the deficit meter, and if the deficit meter is not less than zero, the increment amount equals a third portion of the contribution, and a fourth portion of the contribution is added to the hidden meter. When the progressive jackpot game is won by a player, the visible meter amount is paid to the player, the visible meter is reset to a reset value, the reset value comprising a base reset value plus a random value, and the random value is subtracted from the hidden meter, until the hidden meter reaches zero, and a remainder of the random value, if any, is subtracted from the deficit meter.

In yet another embodiment, a gaming system for playing a progressive jackpot game includes a visible meter, a deficit meter, and a hidden meter. The system comprises a display for displaying a game of chance, an acceptor for receiving a wager, a percentage of the wager defining a contribution to the progressive jackpot game, one or more player-activated buttons for receiving player input, and a processor which processor executes game software and processes player input from the player-activated buttons. Each time the progressive jackpot game is played the visible meter is increased by an increment amount, wherein if the deficit meter is less than zero, the increment amount equals a first portion of the contribution, and a second portion of the contribution is added to the deficit meter, if the deficit meter is not less than zero and the hidden meter is less than a preselected target value, the increment amount equals a third portion of the contribution, and a fourth portion of the contribution is added to the hidden meter, and if the deficit meter is not less than zero and the hidden meter has reached the preselected target value, the increment amount equals the entire contribution. When the progressive jackpot game is won by a player, the visible meter amount is paid to the player, the visible meter is reset to a reset value, the reset value comprising a base reset value plus a random value, and the random value is subtracted from the hidden meter, until the hidden meter reaches zero, and any remainder of the random value, if any, is subtracted from the deficit meter.

Features and advantages will become apparent from the following detailed description of the invention and its various embodiments, taken in conjunction with the accompanying figures and drawings.

BRIEF DESCRIPTION OF THE DRAWINGS

The drawings constitute a part of this specification and may include exemplary embodiments of the present disclosure and illustrate various objects and features thereof. A further understanding of the disclosure may be had by reference to the accompanying drawings in which.

DETAILED DESCRIPTION

Reference will now be made in detail to exemplary embodiments, examples of which are illustrated in the accompanying drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments. In this disclosure, numerous specific details provide a thorough understanding of the subject disclosure. It should be understood that aspects of this disclosure may be practiced with other embodiments not necessarily including all aspects described herein, etc.

Figure 1:
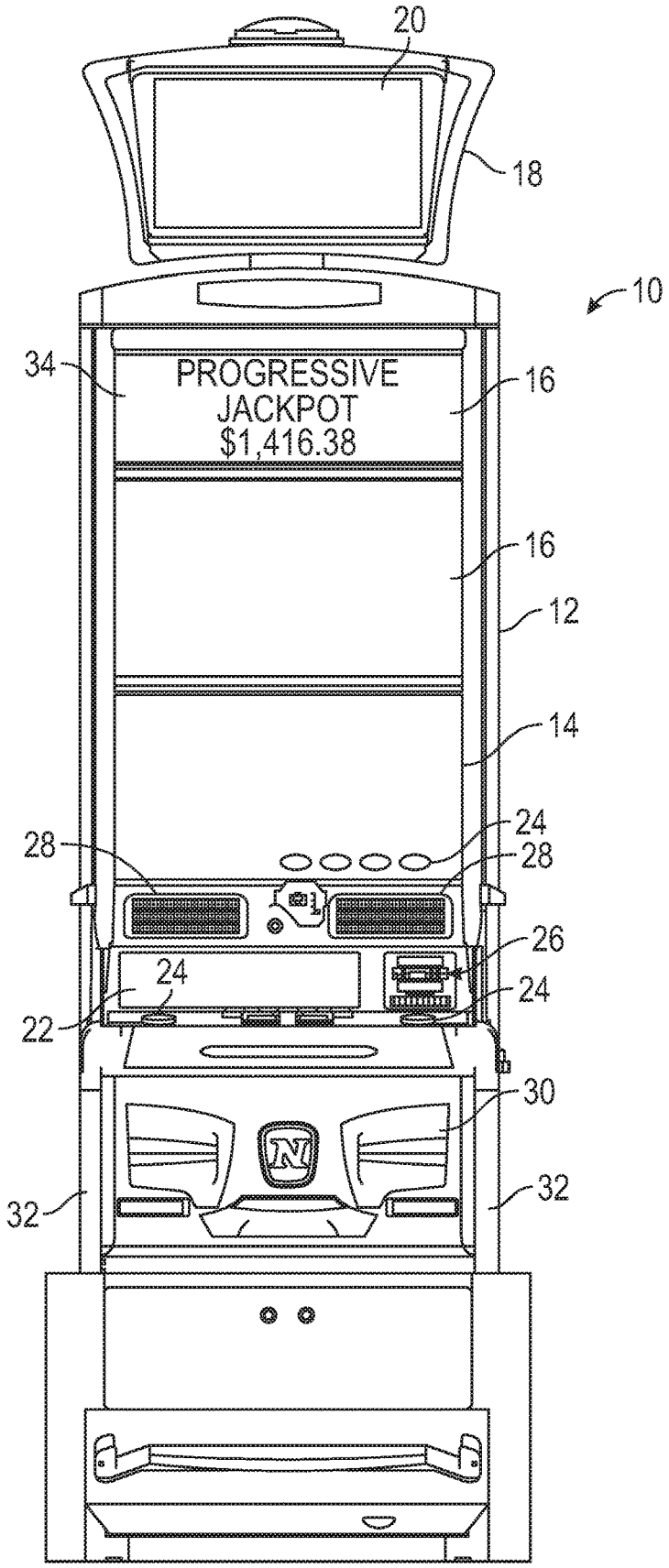
FIG. 1 is a front view of a gaming machine or gaming system in accordance with one or more embodiments.

FIG. 1 shows an electronic gaming machine ("EGM") 10 with a number of components. The EGM 10 may include a cabinet housing 12, primary game display 14, one or more secondary displays 16, and a top box 18, which may include a tertiary display 20. The EGM 10 may further include one or more award meters 34, which may be presented on any of the displays 14, 16, 20, or on any other appropriate location on the housing 12. A primary wagering game and/or a progressive jackpot wagering game may be displayed on one or more of the primary display 14, the secondary displays 16, or the tertiary display 20 of the top box 18. The various displays 14, 16, 20 may also be used to depict signage, advertising, instructions, or other information about the EGM 10 and the gameplay available thereon.

The EGM 10 may further include a player tracking panel 22, player activated buttons 24, a wager acceptor 26 for accepting currency for wagers, and one or more speakers 28 for outputting sound relating to the gameplay of the EGM 10. The cabinet housing 12 may further include signage 30 for advertising other aspects of the game or gameplay. Cabinet housing 12 is preferably a self-standing unit that is generally rectangular in shape and may be manufactured with reinforced steel or other rigid materials that are resistant to tampering and vandalism. The cabinet housing 12 may take on a variety of different configurations depending on the environment in which the EGM 10 is to be deployed. For example, the cabinet housing 12 may comprise a slant-top, bar-top, or table-top style cabinet.

The primary display 14 may be used to show a wagering game of chance, with associated game play and resulting outcomes, and may be in the form of a video display, multi-display (shown) or alternatively, physical reels. Primary game display 14 presents a game of chance wherein an outcome is selected from a plurality of available outcomes, which include winning outcomes and losing outcomes. For certain winning outcomes, the player may receive an award, such a prize, payout, or jackpot from the EGM 10. For example, one such game of chance is a video slot machine game, in which certain combinations of symbols on the display 14 comprise winning outcomes for which such awards are provided. In other aspects of the invention, EGM 10 may present a video or mechanical reel slot machine, a video keno game, a lottery game, a bingo game, a Class II bingo game, a roulette game, a craps game, a blackjack game, a mechanical or video representation of a primary wheel game or the like.

The game displays 14, 16, 20 are typically flat-panel displays in the form of, but not limited to, liquid crystal, LED, plasma, electroluminescent, vacuum fluorescent, field emission, or any other type of panel display known or developed in the art. The game displays 14, 16, 20 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. Additionally, the game displays 14, 16, 20 may include a touch screen or touch glass system that may present to the player various interfaces and controls, such as, credit meters or balances, game symbols, award meters, and input devices such as touch screen buttons 24 on the primary display 14.

Buttons 24 may also be located on the exterior 32 of EGM 10 and can also be used to initiate and control input into and operation of the EGM 10, either instead of, or in addition to the touch screen buttons 24 on the display 14. In another aspect of one embodiment, the plurality of player-activated buttons 24 may be used for various functions such as, but not limited to, selecting a wager denomination, selecting a game to be played, selecting a wager amount per game, initiating a game, or cashing out money from the gaming machine 10. Buttons 24 function as input mechanisms and may include mechanical buttons, electromechanical buttons, touch screen buttons, or other known input devices. In other embodiments, buttons 24 may be replaced with various other input mechanisms known in the art such as, but not limited to, a touch screen system, touch pad, track ball, mouse, switches, toggle switches, or other input means used to accept player input. Optionally, a handle (not shown) may be actuated by a player to initiate a game on the EGM 10.

EGM 10 may further include secondary displays 16 or tertiary displays 20 for displaying other game functions including special awards and features, such as bonuses or progressive jackpot games. The secondary and tertiary displays 16, 20 may be used to display at least one or multiple progressive jackpots that may be won during play of the primary or feature game. Either the primary display 14, any of the secondary displays 16, or the tertiary display 20 may be used to show information to the player such as game play sequences, pay tables, messages, advertising, entertainment screens wheels, jackpot meters and awards, progressive jackpot current value, pointers or reels, or other types of information. The additional displays 16, 20 may or may not include a touch screen or touch glass system.

Game displays 14, 16, 20 may also present information such as, but not limited to, player information, advertisements and casino promotions, graphic displays, news and sports updates, or may even offer alternative games. This information may be generated through a host computer (not shown) networked with gaming machine 10, either on its own initiative, or it may be obtained by request of the player using appropriate input devices, such as the player-activated buttons 24 or virtual buttons 24.

The wager acceptor 26 provides a mechanism by which a player may add currency or other value into the EGM 10 to fund wagers to be placed on gameplay. For example, the wager acceptor 26 may include a bill slot for accepting cash or other currency. Alternatively or additionally the wager acceptor 26 may include a coin slot for accepting coins. The wager acceptor 26 may further include a mechanism for accepting tickets, slips, or other markers representing and/or memorializing wager value in the form of cash, credits, or other currency. The acceptor 26 may include appropriate computer peripherals such as scanners, readers, analyzers or receivers which perform the function of receiving, reading and validating the value of such inserted coins and/or tickets. The acceptor/validator 26 may optionally include ticket printing capabilities, such as those referred to in the industry as Ticket-in, Ticket-out ("TITO") systems. TITO systems may require a ticket reader and ticket printer housed inside of the EGM 10 for accepting bar coded tickets or vouchers printed on a ticket. Acceptor/validator 26 may accept currency in the form of coins, bills and/or tickets from a player and add credit to a bet or wager meter on the EGM 10, which may display to the player the remaining currency available for wagering.

Various award meters 34 may be used to display one or more available awards or jackpots which may result from winning game play. In an embodiment, the award meter 34 may display a progressive jackpot award, which may be won during a progressive jackpot game. The award meter 34 may be of particular interest to a player as it displays a progressive jackpot award which is increasing and changing over time, and is available to be won at the EGM 10, thereby capturing and maintaining a player's attention and excitement during play of the EGM 10. In other embodiments, award meters 34 may display the value of awards associated with the primary wagering game on the EGM. Award meters 34 may be separate display components of the EGM 10, or may be included within or displayed upon the other available displays, including the primary display 14, the secondary displays 16, or the tertiary display 20.

Figure 2:
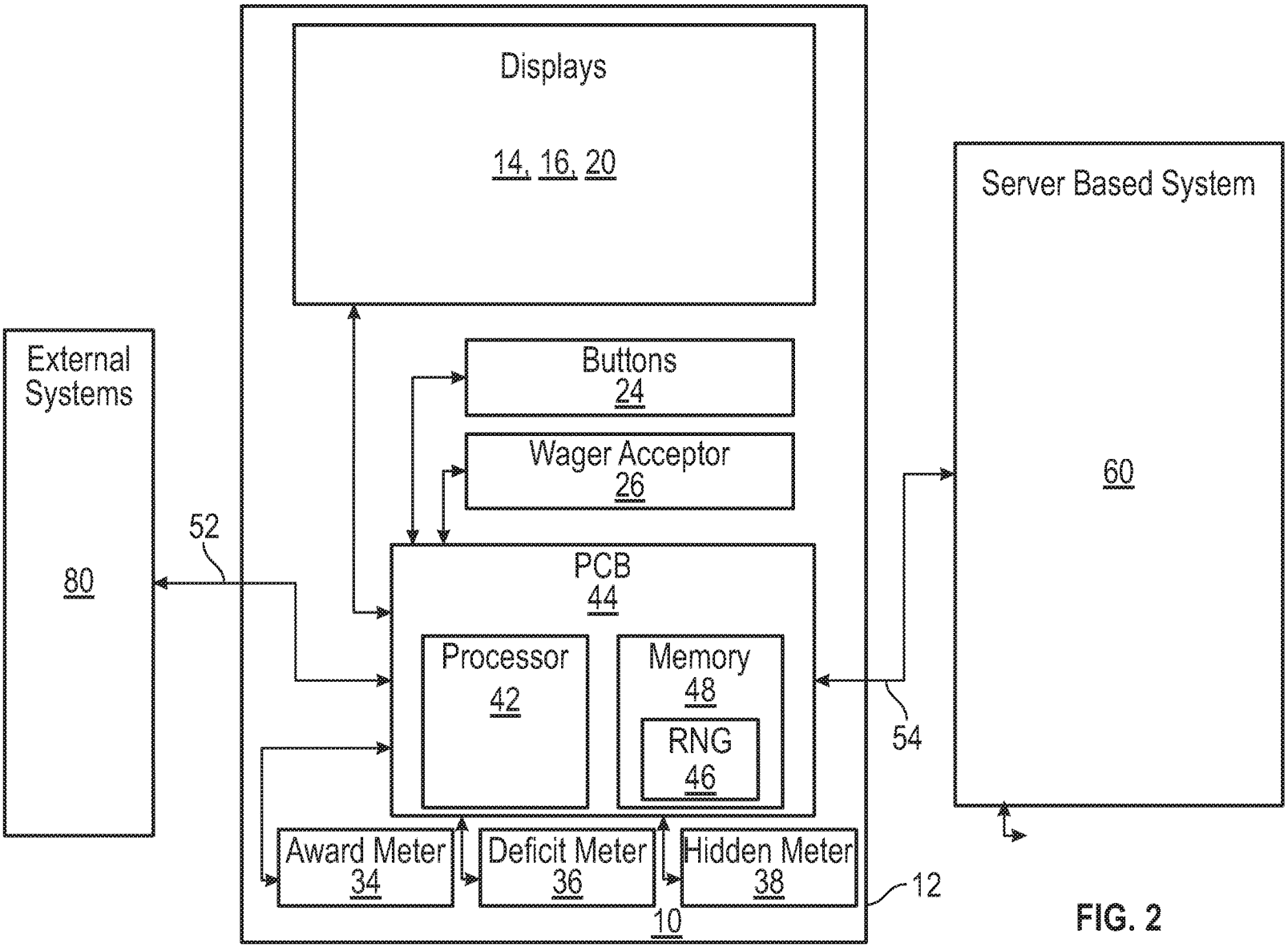
FIG. 2 is a block diagram of the gaming system of FIG. 1, connected to a network including a server based system and other external systems.

FIG. 2 is a block diagram which depicts the internal components and functions of EGM 10, and how the electronic gaming machine 10 may interact with other systems, such as a server based system 60, or another external system 80. Within the cabinet housing 12 of the EGM 10, a processor or controller 42 is provided to control the various functions of the EGM 10. The processor 42 may reside on printed circuit board (or PCB) 44 or other computing board, where it is in communication with a random number generator (RNG) 46, memory 48, and software (not shown) for controlling communications and signals sent and received between the processor 42 and the other components of the EGM 10 (such as the displays 14, 16, 20, the buttons 24, and the acceptor 26).

The EGM 10 includes an award meter 34, which in an embodiment, is a progressive jackpot award meter 34, which displays the current value of a progressive jackpot award available to be won via the EGM 10. Thus, in an embodiment, the award meter 34 is a visible meter, which can be seen by players of the EGM 10. In accordance with the present invention, the EGM 10 may further include a deficit meter 36 and a hidden meter 38, which are in communication with the memory 48, PCB 44, and the processor 42. In an embodiment, the deficit meter 36 and the hidden meter 38 are not visible to the player of the EGM 10, but instead, are used in conjunction with the progressive jackpot award meter 34 to account for and operate the progressive jackpot award as described herein, with relation to FIGS. 3-5.

Operational functions of EGM 10 are controlled by the processor 42. The processor 42 may comprise any one or more processors, microprocessors, controllers, microcontrollers, field programmable devices, or other similar computing devices well known in the art. The processor 42 executes instructions from memory 48 that include operation of the RNG 46, which may be implemented by software and stored in memory 48. In this way, the processor 42 executes the available wagering games on the EGM 10, including displaying the games on the available displays, determining the outcomes of the games, and paying any awards won during gameplay. The memory 48 of the EGM 10 may be random access memory (RAM) or other such memory or data storage devices including, but not limited to, optical drives, flash memory, ROM, and the like. Primary game outcomes and progressive jackpot game outcomes may be determined based on results corresponding to numbers selected by RNG 46.

The EGM 10 may be networked with other devices or systems to form a wagering game system. For example, the EGM 10 may be in communication with a server based system 60, to which it is connected via a network connection 54. The EGM 10 may further be in communication with other external systems 80, via one or more network connections 52. The EGM 10 may further be connected to, or in communication with, a variety of other devices, including other gaming machines, displays, signage, peripherals, or systems, either using the network connections 52, 54 or other available computer and data networks.

In an embodiment, the external systems 80 may include a player tracking system, a slot accounting system, a reward system or a bonusing system. The external systems 80 may be connected to the EGM 10 either through a separate interface board (not shown) or directly integrated with the components of EGM 10 including but not limited to PCB 44. The external systems 80 may also include other components installed on or in EGM 10, for example on or in the cabinet housing 12, such as a player tracking display, a keypad, and a card reader. These components may allow for direct interaction between external systems 80 and the player at EGM 10 to receive information from the player on input devices provided on the EGM 10, or through information on cards inserted into card readers (not shown) or other peripherals, and to display information to the player on one or more displays. A network is established between external systems 80 and EGM 10 via network connection 52, which may be a direct connection between the devices, or may be via one or more intermediary devices such as appropriate network switches, routers, computers or other intermediary devices.

Server based system 60 may also be connected to EGM 10 by a network connection 54 which may be a separate connection or which may share the same network connection 52 as the external systems 80. Server based system 60 may have one or more individual servers tasked with different functions such as communicating with a player at EGM 10 to fulfill requests, delivering services such as television shows or other content, or a host of other functionality or information available from such server based systems 60. The networks 52, 54 may take on a variety of forms and configurations, and may include Local Area Networks (LANs), Wide Area Network (WANs), an intranet or the Internet. Other proprietary computing networks may also be used, including networks such as a Windows network or an Ethernet network. It should be understood that in alternative embodiments, the various components of the EGM 10 described herein, such as the processor 42, memory 48, and RNG 46 may be located and stored within the server based systems 60, or the external systems 80, rather than being physically located inside the housing 12 of the EGM 10. Use of the networks 52, 54 allows connections of large numbers of gaming machines, and systems may be configured to include any number of EGMs.

Typically, when an EGM 10 is connected, powered on and put into service, it undergoes an initialization process controlled by the processor 42. For EGMs 10 that include a progressive jackpot game, it can be common for the progressive jackpot award to be set to a predetermined base reset value (for example, $1,000.00). For regulatory or other reasons, the predetermined base reset value may be constant across a number of networked EGMs, or across a variety of locations, geographies or jurisdictions. Once the progressive jackpot award is reset to the base reset value, it may be displayed via a progressive jackpot award meter 34. As gameplay commences on the EGM 10, and wagers are placed by players (via the acceptor 26), a portion of each wager referred to as a "contribution" maybe used to fund the progressive jackpot award.

In some embodiments, the contribution comprises a percentage of the wager on the game. In other embodiments, the contribution may be a fixed amount, or may depend on other variables. In some embodiments, the entirety of the contribution from a wager may be added to the progressive jackpot award, and the award meter 34 may be incremented or changed to reflect the new, increased amount, after the contribution is added. In other embodiments, such as the embodiments described herein, at times, only a portion of the contribution (the increment amount) is added to the award meter 34, while other portions of the contribution are reserved, held, or potentially added to other meters, such as the deficit meter 36, or the hidden meter 38, as described herein. As described in greater detail below, an operator may use the deficit meter 36 and the hidden meter 38 of the present invention to control the resetting, pace of growth, and overall display of the award meter 34 for a progressive jackpot, while maintaining acceptable accounting practices within the EGM 10 and gaming system.

Figure 3:
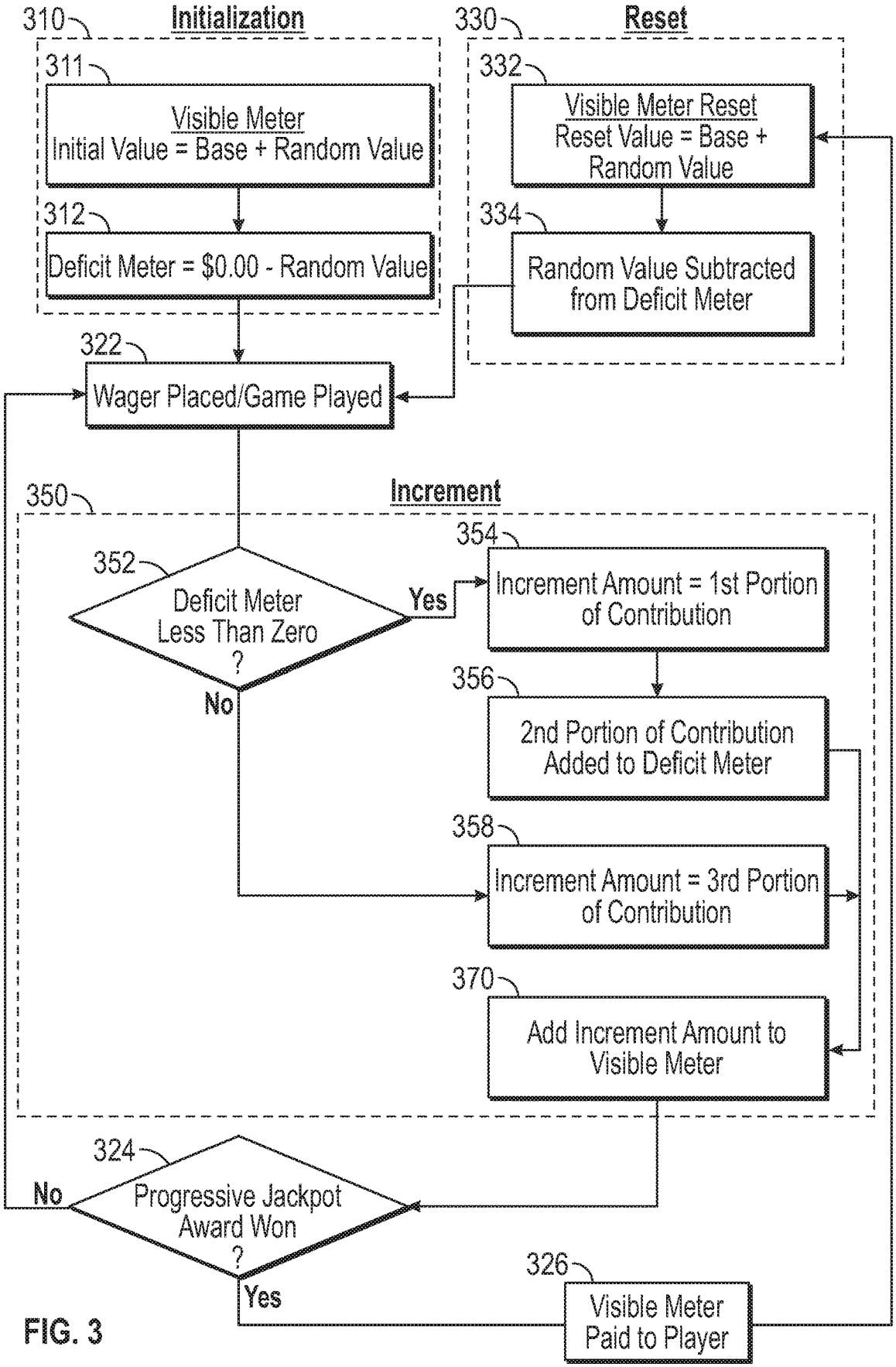
FIG. 3 is a flow diagram of a progressive jackpot game having a deficit meter.

Described below with reference to the flowchart in FIG. 3 is a process for initializing, resetting and operating a gaming machine 10 having a deficit meter 36, according to an embodiment of the present invention. The initialization process is generally shown in box 310, the reset process is generally shown in box 330 and the increment process is shown in box 350. Prior to initialization, the deficit meter 36 is originally set to zero ($0.00). In other embodiments, the deficit meter 36 may be initialized to another selected value. As part of the initialization process 310, when the EGM 10 is put into service, the processor 42 calculates an initial value for the progressive jackpot award meter (visible meter) 34 (step 311). In an embodiment, the initial value of the award meter 34 comprises two parts: a base reset value and an initial random value. The base reset value may be predetermined, for example, $1,000.00. The initial random value may be randomly selected by the processor 42 in conjunction with the RNG 46 from a range of available values, for example between a low and high amount of such range. For example, the initial random value may be selected from a range of $100.00 to $300.00.

In step 312, an amount equal to the selected initial random value is subtracted from the value of the deficit meter 36. Since the deficit meter 36 is originally set to zero, following initialization, subtracting the initial random value from the deficit meter 36 results in a negative number in the deficit meter 36. In this way, the visible award meter 34 is permitted to "borrow" funds from the deficit meter 36 to cause the displayed initial value of the progressive jackpot award to be relatively higher than if only the base reset value was used. The deficit meter 36 accounts for the amount which was used to fund the visible award meter 34, which will be paid back or collected through future gameplay as described herein.

Once initialized, gameplay on the EGM 10 may begin. In step 322, a player provides or places a wager on the progressive jackpot game, and initiates gameplay of the EGM 10, for example, through activation of one or more buttons 24. An increment process commences in step 350. During the increment process 350, an increment amount is calculated depending upon a current value of the deficit meter 36. The increment amount is an amount, either a portion of, or all of, the contribution received from the wager input into the progressive jackpot game. In an embodiment, the contribution is determined and programmed prior to game play, and/or prior to initialization. For example, the contribution may be set to three percent (3%) of the wager, such that if the wager is $1.00, the contribution will be $0.03. Therefore, the increment process 350 determines what portion of the contribution will be added to the visible meter 34, and what portion (if any) will be added to the deficit meter 36.

In step 352, a determination is made as to whether the deficit meter 36 is less than zero ($0.00), or not. If the deficit meter 36 is less than zero, then in step 354 an increment amount is calculated which is equal to a first portion of the contribution. For example, the increment amount may be $0.01 (with the contribution being $0.03). In step 370, the calculated increment amount is then added to the visible meter 34 to increase the value thereof. In step 356, a second portion of the contribution is added to the deficit meter 36. For example, the second portion of the contribution may be $0.02. Thus, the second portion increases the value (i.e., repays the deficit) in the deficit meter 36.

Therefore, in this embodiment, rather than adding the entirety of the contribution to the progressive jackpot award meter 34, only a first portion of the contribution is used to increase the value of the progressive jackpot award meter 34, and a second portion of the contribution is used to increase the value of the deficit meter 36 (in an effort to repay the funds which the deficit meter 36 contributed to the award meter 34 during the initialization or reset process). In this way, the contribution is divided between an increment amount which increases the value displayed on the visible meter 34, and other amounts or portions, which are used to fund the deficit meter 36.

If the deficit meter is not less than zero ($0.00) in step 352, then the increment amount is calculated in a different manner, in step 358. In step 358, the increment amount is calculated to be a third portion of the contribution. In step 370, the calculated increment amount is then added to the visible meter. In an embodiment, the third portion of the contribution is larger than the first portion of the contribution. For example, the third portion of the contribution may be $0.02. In yet another embodiment, the third portion of the contribution comprises the entire amount of the contribution. For example, the third portion of the contribution may be $0.03. Since the deficit meter 36 is not less than zero, all of the funds "borrowed" from the deficit meter 36 have been repaid, and as a result, more (or all) of the contribution may be used to fund the progressive jackpot visible award meter 34.

Following the increment process 350, at step 324, a determination is made as to whether the progressive jackpot game has been won. If the progressive jackpot is won, the amount of the visible meter 34 is paid to the player (in step 326), and the visible meter 34 is reset through the reset process 330. If the progressive jackpot is not won, game play returns to the player making another wager on the progressive jackpot game and once again initiating gameplay, as seen in step 322.

During the reset process 330, in step 332, the visible meter 34 is reset to a new reset value. Similar to the initialization process 310, a new reset value is selected which comprises the base reset value and a newly selected random value. The newly selected random value is again selected from within the range of available random values, between a low and high value for the range. In step 334, the newly selected random value is again subtracted, or debited, from the deficit meter 36, to account for the amount of the random value added to the visible meter 34 during the reset process 330. Prior to step 334, the deficit meter 36 may be at zero ($0.00), or may be a negative number due to prior plays of the progressive jackpot game not generating increment amounts sufficient to "repay" previous amounts debited from the deficit meter 36 and added to the visible meter 34. After the reset process 330 is complete, game play returns to the player making another wager on the progressive jackpot game and once again initiating gameplay, as seen in step 322.

Figure 4:
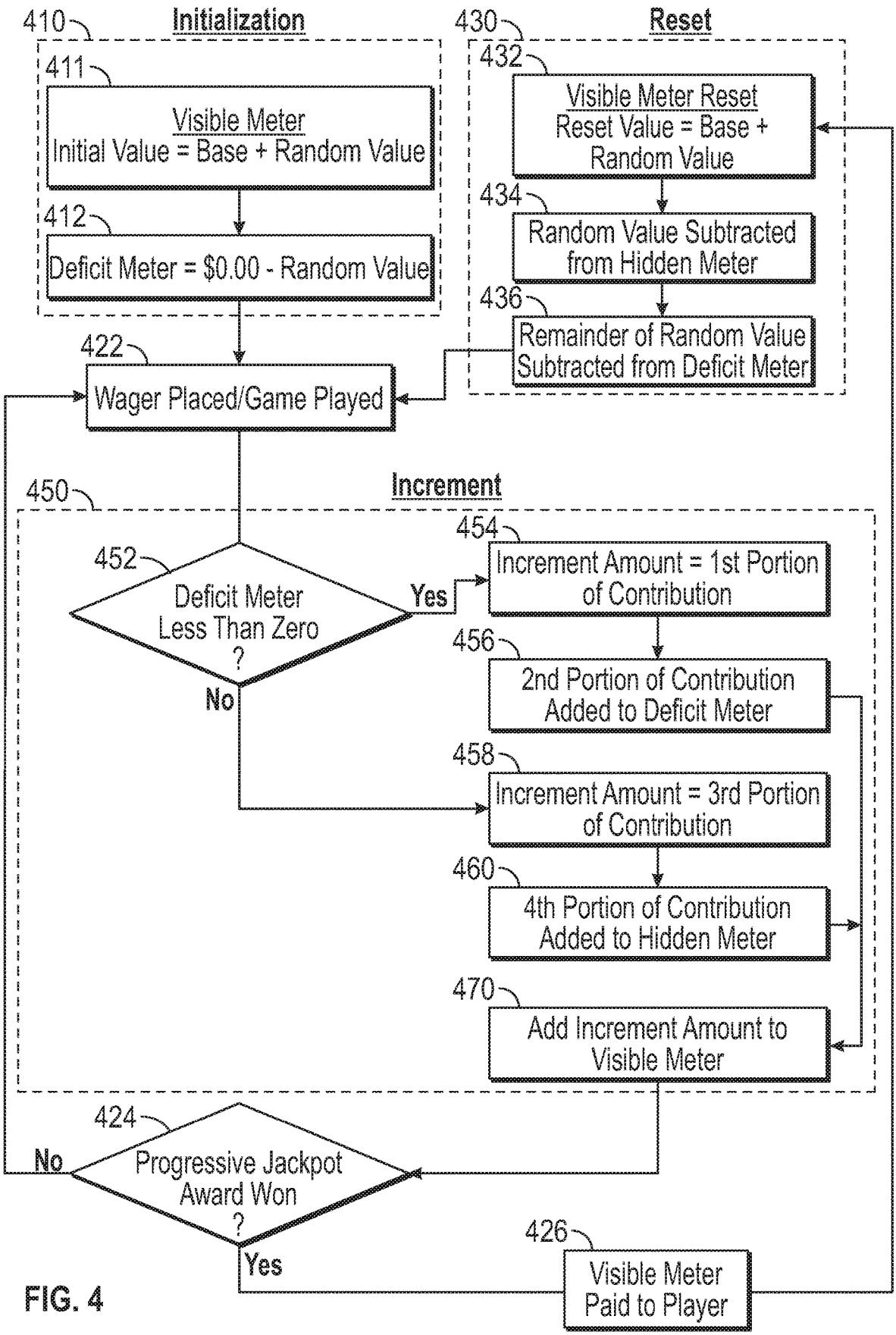
FIG. 4 is a flow diagram of a progressive jackpot game having a deficit meter and a hidden meter, according to a second embodiment.

In an alternative embodiment, the gaming machine 10 or system may include a hidden meter 38 in addition to the deficit meter 36. Described below with reference to the flowchart in FIG. 4 is a process for initializing, resetting and operating a gaming machine 10 having a deficit meter 36 and a hidden meter 38, according to an alternative embodiment of the present invention. The initialization process is generally shown in box 410, the reset process is generally shown in box 430 and the increment process is shown in box 450.

Like the embodiment in FIG. 3, prior to initialization, the deficit meter 36 is originally set to zero ($0.00). As part of the initialization process 410, when the EGM 10 is put into service, the processor 42 calculates an initial value for the progressive jackpot award meter (visible meter) 34 (step 411). In an embodiment, the initial value of the award meter 34 comprises two parts: a base reset value and an initial random value. The base reset value may be predetermined, for example, $1,000.00. The initial random value may be randomly selected by the processor 42 in conjunction with the RNG 46 from a range of available values, for example between a low and high amount of such range. For example, the initial random value may be selected from a range of $100.00 to $300.00.

In step 412, an amount equal to the selected initial random value is subtracted from the value of the deficit meter 36. Since the deficit meter 36 is originally set to zero, following initialization, subtracting the initial random value from the deficit meter 36 results in a negative number in the deficit meter 36. In this way, the visible award meter 34 is permitted to "borrow" funds from the deficit meter 36 to cause the displayed initial value of the progressive jackpot award to be relatively higher than if only the base reset value was used. The deficit meter 36 accounts for the amount which was used to fund the visible award meter 34, which will be paid back or collected through future gameplay as described herein.

Once initialized, gameplay on the EGM 10 may begin. In step 422, a player provides or places a wager on the progressive jackpot game, and initiates gameplay of the EGM 10, for example, through activation of one or more buttons 24. An increment process commences in step 450. During the increment process 450, an increment amount is calculated depending upon a current value of the deficit meter 36. The increment amount is an amount, either a portion of, or all of, the contribution received from the wager input into the progressive jackpot game. In an embodiment, the contribution is determined and programmed prior to game play, and/or prior to initialization. For example, the contribution may be set to three percent (3%) of the wager, such that if the wager is $1.00, the contribution will be $0.03. Therefore, the increment process 450 determines what portion of the contribution will be added to the visible meter 34, and what portions (if any) will be added to the deficit meter 36 and the hidden meter 38.

In step 452, a determination is made as to whether the deficit meter 36 is less than zero ($0.00), or not. If the deficit meter 36 is less than zero, then in step 454 an increment amount is calculated which is equal to a first portion of the contribution. For example, the increment amount may be $0.01 (with the contribution being $0.03). In step 470, the calculated increment amount is then added to the visible meter 34 to increase the value thereof. In step 456, a second portion of the contribution is added to the deficit meter 36. For example, the second portion of the contribution may be $0.02. Thus, the second portion increases the value (i.e., repays the deficit) in the deficit meter 36.

If the deficit meter is not less than zero ($0.00) in step 452, then the increment amount is calculated in a different manner, in step 458. In step 458, the increment amount is calculated to be a third portion of the contribution and in step 460, a fourth portion of the contribution is added to the hidden meter 38. In step 470, the calculated increment is then added to the visible meter. In an embodiment, the third portion of the contribution is larger than the first portion of the contribution. For example, the third portion of the contribution may be $0.02. In yet another embodiment, the fourth portion comprises a remainder of the contribution once the third portion is deducted. For example, the third portion of the contribution may be $0.02, and the fourth portion may be $0.01. Since the deficit meter 36 is not less than zero, all of the funds "borrowed" from the deficit meter 36 have been repaid, and as a result, more of the contribution, that is, a larger third portion may be used to fund the progressive jackpot visible award meter 34, with a fourth portion (or remainder) of the contribution being used to fund the hidden meter 38.

In this way, the hidden meter 38 collects a surplus of the increment amounts from the contribution which can be used to fund a subsequent progressive jackpot during a reset process 430. Following the increment process 450, at step 424, a determination is made as to whether the progressive jackpot game has been won. If the progressive jackpot is won, the amount of the visible meter 34 is paid to the player (in step 426), and the visible meter 34 is reset through the reset process 430, described below. If the progressive jackpot is not won, game play returns to the player making another wager on the progressive jackpot game and once again initiating gameplay, as seen in step 422.

During the reset process 430, in step 432, the visible meter 34 is reset to a new reset value. A new reset value is selected which comprises the base reset value and a newly selected random value. The newly selected random value is again selected from within the range of available random values, between a low and high value for the range.

However, since this embodiment includes a hidden meter 38, the newly selected random value used to fund the visible meter 34 is first deducted from the surplus collected in the hidden meter 38, and if any remainder of the random value remains, it is then deducted from the deficit meter 36. Thus, in step 434, the newly selected random value is first subtracted from the hidden meter 38. If the hidden meter 38 remains a positive value following step 434, the reset process is complete, and the hidden meter 38 remains at its then current value until further gameplay resumes. However, if deduction of the newly selected random value results in the hidden meter 38 being depleted to zero ($0.00), then in step 436, any remainder of the newly selected random value is subtracted or deducted from the deficit meter 36. In this way, during the reset process, the selected random value is first subtracted from the hidden meter 38 until the hidden meter reaches zero, and a remainder of the random value, if any, is subtracted from the deficit meter 36. Prior to step 434, the deficit meter 36 may be at zero ($0.00), or may be a negative number due to prior plays of the progressive jackpot game not generating increment amounts sufficient to "repay" previous amounts debited from the deficit meter 36 and added to the visible meter 34. After the reset process 430 is complete, game play returns to the player making another wager on the progressive jackpot game and once again initiating gameplay, as seen in step 422.

Figure 5:
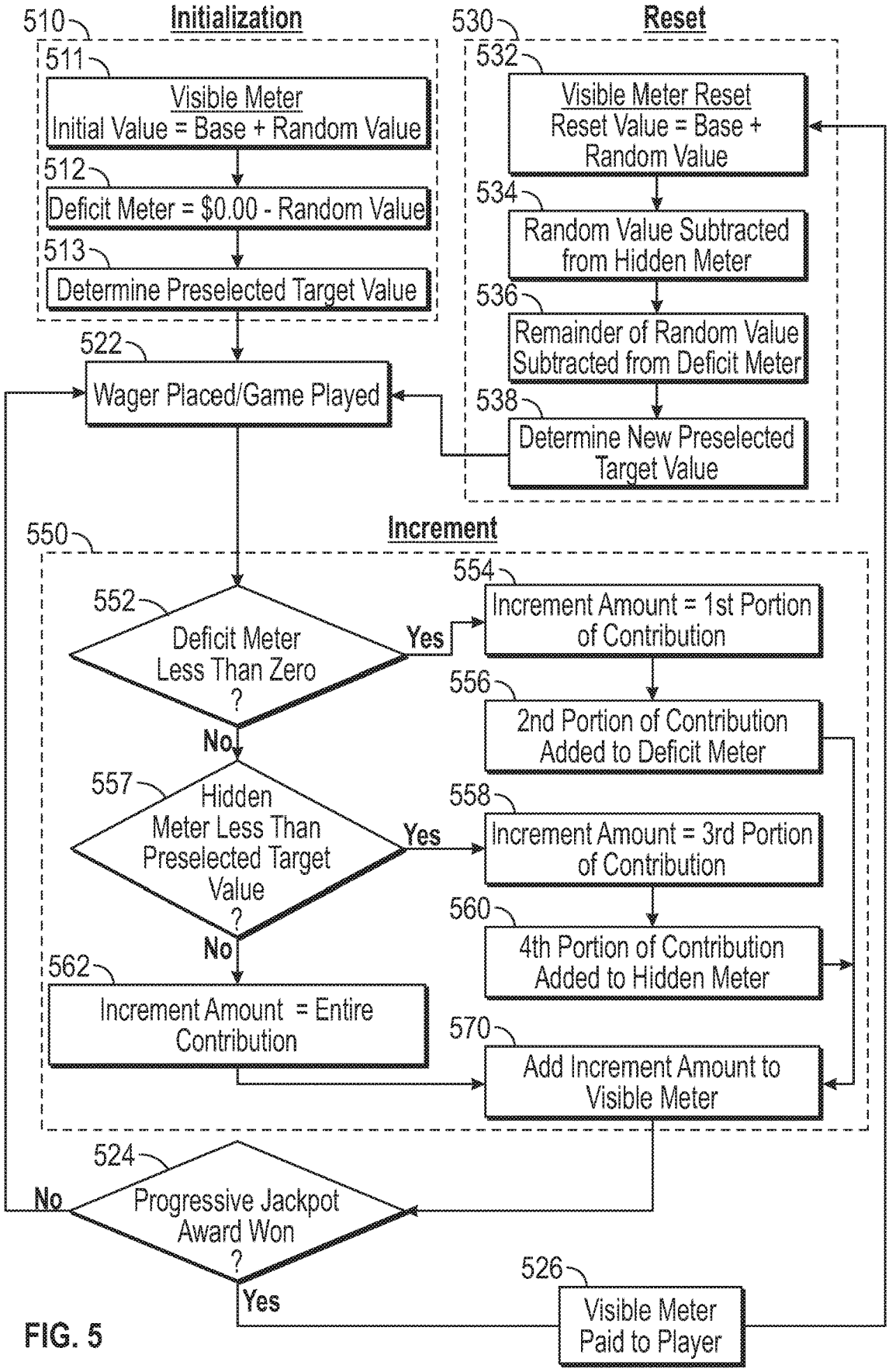
FIG. 5 is a flow diagram of a progressive jackpot game having a deficit meter and a hidden meter, according to a third embodiment.

In yet another alternative embodiment, the gaming machine 10 or system may include a hidden meter 38 having a preselected target value, in addition to the deficit meter 36. Described below with reference to the flowchart in FIG. 5 is a process for initializing, resetting and operating a gaming machine 10 having a deficit meter 36 and a hidden meter 38 having a preselected target value, according to an alternative embodiment of the present invention. The initialization process is generally shown in box 510, the reset process is generally shown in box 530 and the increment process is shown in box 550.

Like the embodiment in FIG. 4, prior to initialization, the deficit meter 36 is originally set to zero ($0.00). As part of the initialization process 510, when the EGM 10 is put into service, the processor 42 calculates an initial value for the progressive jackpot award meter (visible meter) 34 (step 511). In an embodiment, the initial value of the award meter 34 comprises two parts: a base reset value and an initial random value. The base reset value may be predetermined, for example, $1,000.00. The initial random value may be randomly selected by the processor 42 in conjunction with the RNG 46 from a range of available values, for example between a low and high amount of such range. For example, the initial random value may be selected from a range of $100.00 to $300.00.

In step 512, an amount equal to the selected initial random value is subtracted from the value of the deficit meter 36. Since the deficit meter 36 is originally set to zero, following initialization, subtracting the initial random value from the deficit meter 36 results in a negative number in the deficit meter 36. In this way, the visible award meter 34 is permitted to "borrow" funds from the deficit meter 36 to cause the displayed initial value of the progressive jackpot award to be relatively higher than if only the base reset value was used. The deficit meter 36 accounts for the amount which was used to fund the visible award meter 34, which will be paid back or collected through future gameplay as described herein.

In this embodiment, during the initialization process 510 (or at some other appropriate time prior to gameplay being initiated), the EGM 10 further determines a preselected target value for the hidden meter 38, at step 513, which may be used during the subsequent reset process 530. In an embodiment, the preselected target value is randomly selected by the processor 42 in conjunction with the RNG 46 from a range of available target values, for example between a low and high amount of such range. For example, the preselected target value may be selected from a range of $100.00 to $300.00. Moreover, in an embodiment, the subsequent random value may be set to be equal to the previous preselected target value during the reset process 530 (rather than being randomly selected from a range). In other words, in selecting the preselected target value, the processor 42 may also assign the same value to the next random value to be used by the reset process 530. While determination of the preselected target value, at step 513, is depicted in FIG. 5 as being the last step of the initialization process 510, in alternative embodiments, the preselected target value may be conducted at any time during initialization, including prior to, after, at the same time as, or in between steps 511 and 512.

Once initialized, gameplay on the EGM 10 may begin. In step 522, a player provides or places a wager on the progressive jackpot game, and initiates gameplay of the EGM 10, for example, through activation of one or more buttons 24. An increment process commences in step 550. During the increment process 550, an increment amount is calculated depending upon a current value of the deficit meter 36. The increment amount is an amount, either a portion of, or all of, the contribution received from the wager input into the progressive jackpot game. In an embodiment, the contribution is determined and programmed prior to game play, and/or prior to initialization. For example, the contribution may be set to three percent (3%) of the wager, such that if the wager is $1.00, the contribution will be $0.03. Therefore, the increment process 550 determines what portion of the contribution will be added to the visible meter 34, and what portions (if any) will be added to the deficit meter 36 and the hidden meter 38.

In step 552, a determination is made as to whether the deficit meter 36 is less than zero ($0.00), or not. If the deficit meter 36 is less than zero, then in step 554 an increment amount is calculated which is equal to a first portion of the contribution. For example, the increment amount may be $0.01 (with the contribution being $0.03). In step 570, the calculated increment amount is then added to the visible meter 34 to increase the value thereof. In step 556, a second portion of the contribution is added to the deficit meter 36. For example, the second portion of the contribution may be $0.02. Thus, the second portion increases the value (i.e., repays the deficit) in the deficit meter 36.

If the deficit meter is not less than zero ($0.00) in step 552, then the increment amount is calculated in a different manner. In step 557, a secondary determination is made to determine whether the hidden meter 38 is less than the preselected target value. If the hidden meter 38 is less than the preselected target value, then in step 558, the increment amount is calculated to be a third portion of the contribution, and in step 560, a fourth portion of the contribution is added to the hidden meter 38. In step 570, the calculated increment amount is then added to the visible meter. In an embodiment, the third portion of the contribution is larger than the first portion of the contribution. For example, the third portion of the contribution may be $0.02. In yet another embodiment, the fourth portion comprises a remainder of the contribution once the third portion is deducted. For example, the third portion of the contribution may be $0.02, and the fourth portion may be $0.01.

However, in step 557, if the hidden meter 38 is not less than the preselected value (the hidden meter 38 has reached the preselected target value), then the increment amount is set to be all of, or the entirety of the contribution, in step 562. Again, in step 570, the calculated increment amount is added to the visible meter. In alternative embodiments, in step 562 the increment amount may be set to be less than the entire amount of the contribution, such as comprising most of the contribution, half of the contribution, or a small portion of the contribution. In these ways, the increment process 550 may be configured to use relatively small increment amounts when the deficit meter 36 is negative, moderate sized increment amounts when the deficit meter 36 is not less than zero but the hidden meter 38 is below the preselected target value, and larger increment amounts (the entirety of the contribution) when the hidden meter 38 has reached the preselected target value.

In this way, the hidden meter 38 collects a surplus of the increment amounts from the contribution which can be used to fund a subsequent progressive jackpot during the reset process 530. Following the increment process 550, at step 524, a determination is made as to whether the progressive jackpot game has been won. If the progressive jackpot is won, the amount of the visible meter 34 is paid to the player (in step 526), and the visible meter 34 is reset through the reset process 530, described below. If the progressive jackpot is not won, game play returns to the player making another wager on the progressive jackpot game and once again initiating gameplay, as seen in step 522.

During the reset process 530, in step 532, the visible meter 34 is reset to a new reset value. A new reset value is selected which comprises the base reset value and a newly selected random value. In an embodiment, the newly selected random value is again selected from within the range of available random values, between a low and high value for the range. In an alternative embodiment, the newly selected random value is assigned to the previously determined preselected target value (in steps 513 or 538). In such embodiments, a preselected target value may serve as the next random value used in step 532 (which was randomly determined at the time the preselected target value was determined, during initialization in step 513, or during reset in step 538).

However, since this embodiment includes a hidden meter 38, the newly selected random value used to fund the visible meter 34 is first deducted from the surplus collected in the hidden meter 38, and if any remainder of the random value remains, it is then deducted from the deficit meter 36. Thus, in step 534, the new random value selected in step 532 is first subtracted from the hidden meter 38. If the hidden meter 38 remains a positive value following step 534, the reset process is complete, and the hidden meter 38 remains at its then current value until further gameplay resumes. However, if deduction of the new random value results in the hidden meter 38 being depleted to zero ($0.00), then in step 536, any remainder of the newly selected random value is subtracted or deducted from the deficit meter 36. In this way, during the reset process, the selected random value is first subtracted from the hidden meter 38 until the hidden meter reaches zero, and a remainder of the random value, if any, is subtracted from the deficit meter 36. Prior to step 534, the deficit meter 36 may be at zero ($0.00), or may be a negative number due to prior plays of the progressive jackpot game not generating increment amounts sufficient to "repay" previous amounts debited from the deficit meter 36 and added to the visible meter 34.

In step 538, a new preselected target value is determined to be used for a subsequent play of the progressive jackpot wagering game. This process is similar to the initial determination of the preselected target value in step 513 of the initialization process. Thus, in an embodiment, the new preselected target value may be a randomly selected by the processor 42 in conjunction with the RNG 46 from a range of available target values, for example between a low and high amount of such range. If the game has been configured such that the preselected target value (from either step 513 or step 538) is used to set the next random value in step 532, then if the progressive jackpot game is won after the hidden meter 38 reaches the preselected target value, the reset process 530 will result in the hidden meter 38 having a zero balance. This occurs because the hidden meter 38 is not permitted to increment beyond the preselected target value during the increment process 550 (because when the hidden meter 38 reaches the preselected target value it stops incrementing, and the increment amount is calculated to be the entire contribution, in step 562). Thereafter, when the reset process 530 commences, subtracting the random value from the hidden meter 38 (i.e., subtracting the random value from the preselected target value, which are equal amounts), results in a zero balance in the hidden meter 38. After the reset process 530 is complete, game play returns to the player making another wager on the progressive jackpot game and once again initiating gameplay, as seen in step 522.

It should be understood that in the embodiments depicted in FIGS. 3, 4, and 5, the steps of the process may be executed in other orders than in the order shown and described. For example, with reference to FIG. 3, the determination of whether the progressive jackpot award has been won, in step 324, may be executed prior to the increment process 350 or the reset process 330. Thus, in an embodiment, the increment process 350 of adding the increment amount to the visible meter 34 may occur before, during or after play of the progressive jackpot game, but is generally contemporaneous therewith. Other variations of ordering of the steps are possible as well.

The gaming machines 10 and systems of the present invention offer a number of advantages over traditional gaming machines and progressive jackpots. For example, using the deficit meter 36 allows the progressive jackpot award to reset at a generally higher amount by adding the random value to the base reset value in creating the initial or reset value of the progressive jackpot award. This relatively higher amount displayed on the visible meter 34 of the gaming machine 10 causes increased interest and excitement to players, driving player traffic to such gaming devices 10. Moreover, through the mechanism of repayment of the deficit meter 36, and optional funding of the hidden meter 38, the speed at which the visible meter 34 increases will increase over time. While only a first portion of the contribution is initially used to fund the visible meter 34 during gameplay following initialization or reset, later on after the deficit meter 36 is repaid, the rate of funding will increase or "jump" as a greater portion (or even all) of the contribution is used to fund the visible meter 34. If the optional hidden meter 38 is also used, the increased funding may be even more noticeable after yet another "jump" in the pace of funding the visible meter 34 and rate of growth of the progressive jackpot award. In this way, these increases in funding will be noticeable to players and will further their excitement and interest in gameplay as the progressive jackpot award increases at a greater rate on the visible meter 34, attracting greater play of the progressive jackpot game on the EGM 10.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. Further, it will be understood that certain features and combinations may be of utility and may be employed within the scope of the disclosure. Various steps of the described processes set forth herein may be carried out in orders that differ from those described without departing from the scope of the present methods. It is to be understood that while certain forms of the present disclosure have been illustrated and described herein, it is not to be limited to the specific forms or arrangement of parts described and shown.

The invention claimed is:

1. A gaming system for playing a progressive jackpot game, wherein the progressive jackpot game has a visible meter and a deficit meter, the gaming system comprising:

a display for displaying a game of chance;

an acceptor for receiving a wager, a percentage of the wager defining a contribution to the progressive jackpot game;

one or more player-activated buttons for receiving player input; and a processor, wherein the processor executes game software and processes player input from the player-activated buttons;

wherein each time the progressive jackpot game is played the visible meter is increased by an increment amount, wherein (i) if the deficit meter is less than zero, the increment amount equals a first portion of the contribution, and a second portion of the contribution is added to the deficit meter, and (ii) if the deficit meter is not less than zero, the increment amount equals a third portion of the contribution;

wherein when the progressive jackpot game is won by a player, (i) the visible meter amount is paid to the player, (ii) the visible meter is reset to a reset value, the reset value comprising a base reset value plus a random value, and (iii) the random value is subtracted from the deficit meter.

2. The gaming system of claim 1, wherein the visible meter is increased by the increment amount after the progressive jackpot game has been played and has not been won by the player.

3. The gaming system of claim 1, wherein the third portion of the contribution is larger than the first portion of the contribution.

4. The gaming system of claim 1, wherein the third portion of the contribution comprises the entire contribution.

5. The gaming system of claim 1, wherein when the progressive jackpot game is initialized, the visible meter is set to an initial value, the initial value comprising the base reset value plus an initial random value, and the deficit meter is set to zero minus the initial random value.

6. The gaming system of claim 5, wherein the initial random value is selected from a predefined range of available values.

7. The gaming system of claim 1, wherein the availability of the progressive jackpot game is restricted based on the size of the wager.

8. The gaming system of claim 1, wherein a probability of winning the progressive jackpot game is dependent upon the size of the wager.

9. The gaming system of claim 1, wherein the base reset value is static and remains constant within a jurisdiction.

10. A gaming system for playing a progressive jackpot game, wherein the progressive jackpot game has a visible meter, a deficit meter, and a hidden meter, the gaming system comprising:

a display for displaying a game of chance;

an acceptor for receiving a wager, a percentage of the wager defining a contribution to the progressive jackpot game;

one or more player-activated buttons for receiving player input; and a processor, wherein the processor executes game software and processes player input from the player-activated buttons;

wherein each time the progressive jackpot game is played the visible meter is increased by an increment amount, wherein (i) if the deficit meter is less than zero, the increment amount equals a first portion of the contribution, and a second portion of the contribution is added to the deficit meter, and (ii) if the deficit meter is not less than zero, the increment amount equals a third portion of the contribution, and a fourth portion of the contribution is added to the hidden meter;

wherein when the progressive jackpot game is won by a player, (i) the visible meter amount is paid to the player, (ii) the visible meter is reset to a reset value, the reset value comprising a base reset value plus a random value, and (iii) the random value is subtracted from the hidden meter, until the hidden meter reaches zero, and a remainder of the random value, if any, is subtracted from the deficit meter.

11. The gaming system of claim 10, wherein the visible meter is increased by the increment amount after the progressive jackpot game has been played and has not been won by the player.

12. The gaming system of claim 10, wherein the third portion of the contribution is larger than the first portion of the contribution.

13. The gaming system of claim 10, wherein the fourth portion of the contribution is smaller than the third portion of the contribution.

14. The gaming system of claim 10, wherein when the progressive jackpot game is initialized, the visible meter is set to an initial value, the initial value comprising the base reset value plus an initial random value, and the deficit meter is set to zero minus the initial random value.

15. The gaming system of claim 14, wherein the initial random value is selected from a predefined range of available values.

16. The gaming system of claim 10, wherein the availability of the progressive jackpot game is restricted based on the size of the wager.

17. The gaming system of claim 10, wherein a probability of winning the progressive jackpot game is dependent upon the size of the wager.

18. The gaming system of claim 10, wherein the base reset value is static and remains constant within a jurisdiction.

19. A gaming system for playing a progressive jackpot game, wherein the progressive jackpot game has a visible meter, a deficit meter, and a hidden meter, the gaming system comprising:

a display for displaying a game of chance;

an acceptor for receiving a wager, a percentage of the wager defining a contribution to the progressive jackpot game;

one or more player-activated buttons for receiving player input; and a processor, wherein the processor executes game software and processes player input from the player-activated buttons;

wherein each time the progressive jackpot game is played the visible meter is increased by an increment amount, wherein (i) if the deficit meter is less than zero, the increment amount equals a first portion of the contribution, and a second portion of the contribution is added to the deficit meter, (ii) if the deficit meter is not less than zero and the hidden meter is less than a preselected target value, the increment amount equals a third portion of the contribution, and a fourth portion of the contribution is added to the hidden meter; and (iii) if the deficit meter is not less than zero and the hidden meter has reached the preselected target value, the increment amount equals the entire contribution;

wherein when the progressive jackpot game is won by a player, (i) the visible meter amount is paid to the player, (ii) the visible meter is reset to a reset value, the reset value comprising a base reset value plus a random value, and (iii) the random value is subtracted from the hidden meter, until the hidden meter reaches zero, and any remainder of the random value, if any, is subtracted from the deficit meter.

20. The gaming system of claim 19, wherein the visible meter is increased by the increment amount after the progressive jackpot game has been played and has not been won by the player.

21. The gaming system of claim 19, wherein when the progressive jackpot is won by a player, a new preselected target value is determined.

22. The gaming system of claim 19, wherein the third portion of the contribution is larger than the first portion of the contribution.

23. The gaming system of claim 19, wherein when the progressive jackpot game is initialized, the visible meter is set to an initial value, the initial value comprising the base reset value plus an initial random value, and the deficit meter is set to zero minus the initial random value.

24. The gaming system of claim 23, wherein the initial random value is selected from a predefined range of available values.

25. The gaming system of claim 19, wherein when the progressive jackpot game is initialized, the preselected target value is selected by the processor.

26. The gaming system of claim 25, wherein the preselected target value is selected from a predefined range of available values.

27. The gaming system of claim 19, wherein the random value is set to an amount equal to the preselected target value.

28. The gaming system of claim 27, wherein when the progressive jackpot is won by a player, a new preselected target value is determined.

29. The gaming system of claim 19, wherein the availability of the progressive jackpot game is restricted based on the size of the wager.

30. The gaming system of claim 19, wherein a probability of winning the progressive jackpot game is dependent upon the size of the wager.

* * * * *